US010533795B2

(12) United States Patent
Lochner

(10) Patent No.: US 10,533,795 B2
(45) Date of Patent: Jan. 14, 2020

(54) METHOD FOR OBTAINING AN AIR PRODUCT IN AN AIR SEPARATING SYSTEM WITH TEMPORARY STORAGE, AND AIR SEPARATING SYSTEM

(71) Applicant: LINDE AKTIENGESELLSCHAFT, Munich (DE)

(72) Inventor: Stefan Lochner, Grafing (DE)

(73) Assignee: LINDE AKTIENGESELLSCHAFT, Munich (DE)

( * ) Notice: Subject to any disclaimer, the term of this patent is extended or adjusted under 35 U.S.C. 154(b) by 822 days.

(21) Appl. No.: 14/782,606

(22) PCT Filed: Apr. 8, 2014

(86) PCT No.: PCT/EP2014/000937
§ 371 (c)(1),
(2) Date: Oct. 6, 2015

(87) PCT Pub. No.: WO2014/173496
PCT Pub. Date: Oct. 30, 2014

(65) Prior Publication Data

US 2016/0069611 A1 Mar. 10, 2016

(30) Foreign Application Priority Data

Apr. 25, 2013 (EP) ..... 13002196

(51) Int. Cl.
*F25J 3/04* (2006.01)
*F17C 7/04* (2006.01)

(52) U.S. Cl.
CPC ..... *F25J 3/04527* (2013.01); *F17C 7/04* (2013.01); *F25J 3/04412* (2013.01); *F17C 2221/011* (2013.01); *F25J 2215/50* (2013.01)

(58) Field of Classification Search
CPC ..... F25J 3/04472–04515; F25J 3/04812–0486
See application file for complete search history.

(56) References Cited

U.S. PATENT DOCUMENTS

| | | | | |
|---|---|---|---|---|
| 5,148,680 | A | 9/1992 | Dray | |
| 6,295,840 | B1 | 10/2001 | Smith | |
| 2008/0289362 | A1 | 11/2008 | Lochner et al. | |
| 2013/0053998 | A1 * | 2/2013 | Singhal | F25J 3/04848 700/108 |

FOREIGN PATENT DOCUMENTS

| | | | |
|---|---|---|---|
| DE | 676616 | C | 6/1939 |
| EP | 1544559 | A1 | 6/2005 |
| JP | H03282182 | A | 12/1991 |

* cited by examiner

*Primary Examiner* — Tareq Alosh
(74) *Attorney, Agent, or Firm* — Millen White Zelano & Branigan, PC

(57) ABSTRACT

A method for obtaining an air product in an air separating system in which a liquid fraction is obtained from feed air and used to provide the air product and in which the liquid fraction is temporarily stored in a tank arrangement. A tank arrangement with at least two tanks is used, and the liquid fraction is fed to at least one of the tanks and/or is removed from at least one of the tanks in order to provide the air product. In the process, the liquid fraction is not fed to and removed from any one of the tanks at the same time, and the composition of the liquid fraction in a tank is ascertained prior to each removal of the liquid fraction from the tank. An air separating system is also described.

12 Claims, 2 Drawing Sheets

METHOD FOR OBTAINING AN AIR PRODUCT IN AN AIR SEPARATING SYSTEM WITH TEMPORARY STORAGE, AND AIR SEPARATING SYSTEM

The present invention relates to a method for obtaining an air product in an air separating plant and to an air separating plant set up for carrying out such a method.

PRIOR ART

The production of oxygen or of corresponding mixtures in the liquid or gaseous state typically takes place by cryogenic separation of air in air separating plants having distillation column systems which are known per se. These can for example take the form of single- or two-column systems, in particular as conventional double-column systems, but can also take the form of three- or multi-column systems. Within the context of this invention, use is in particular made of a distillation column system that comprises a nitrogen column in the form of a single-column apparatus with an additional column for the production of oxygen. Furthermore, provision may be made in the above-mentioned distillation column systems of devices, for example columns, for obtaining further air components, in particular the noble gases krypton, xenon and/or argon.

Compressed oxygen is required for a range of industrial uses, and in order to produce it use can be made of air separating plants with what is referred to as internal compression. In such separating plants, a liquid fraction, in particular liquid oxygen, which is pressurized in the liquid state is vaporized against a heat transfer medium and is finally discharged as a pressurized gas product. The internal compression has, inter alia, energetic advantages in comparison to subsequent compression of an oxygen product stream which already exists in gas form.

In that context, there is no phase transition proper at supercritical pressure; the liquid fraction is "pseudo-vaporized". The (pseudo-)vaporizing liquid fraction liquefies the heat transfer medium which is at high pressure (or, as the case may be, pseudo-liquefies the latter if it is at supercritical pressure). The heat transfer medium is frequently formed by part of the air supplied to the air separating plant.

Internal compression is for example described in the following documents: DE 830 805 B, DE 901 542 B (corresponds to U.S. Pat. No. 2,712,738 A/U.S. Pat. No. 2,784,572 A), DE 952 908 B, DE 1 103 363 B (U.S. Pat. No. 3,083,544 A), DE 1 112 997 B (U.S. Pat. No. 3,214,925 A), DE 1 124 529 B, DE 1 117 616 B (U.S. Pat. No. 3,280,574 A), DE 1 226 616 A (U.S. Pat. No. 3,216,206 A), DE 1 229 561 B (U.S. Pat. No. 3,222,878 A), DE 1 199 293 B, DE 1 187 248 B (U.S. Pat. No. 3,371,496 A), DE 1 235 347 B, DE 1 258 882 A (U.S. Pat. No. 3,426,543 A), DE 1 263 037 A (U.S. Pat. No. 3,401,531 A), DE 1 501 722 A (U.S. Pat. No. 3,416,323 A), DE 1 501 723 A (U.S. Pat. No. 3,500,651 A), DE 25 351 32 B2 (U.S. Pat. No. 4,279,631 A), DE 26 46 690 A1, EP 0 093 448 B1 (U.S. Pat. No. 4,555,256 A), EP 0 384 483 B1 (U.S. Pat. No. 5,036,672 A), EP 0 505 812 B1 (U.S. Pat. No. 5,263,328 A), EP 0 716 280 B1 (U.S. Pat. No. 5,644,934 A), EP 0 842 385 B1 (U.S. Pat. No. 5,953,937 A), EP 0 758 733 B1 (U.S. Pat. No. 5,845,517 A), EP 0 895 045 B1 (U.S. Pat. No. 6,038,885 A), DE 198 03 437 A1, EP 0 949 471 B1 (U.S. Pat. No. 6,185,960 B1), EP 0 955 509 A1 (U.S. Pat. No. 6,196,022 B1), EP 1 031 804 A1 (U.S. Pat. No. 6,314,755 B1), DE 199 09 744 A1, EP 1 067 345 A1 (U.S. Pat. No. 6,336,345 B1), EP 1 074 805 A1 (U.S. Pat. No. 6,332,337 B1), EP 199 54 593 A1, EP 1 134 525 A1 (U.S. Pat. No. 6,477,860 B2), DE 100 13 073 A1, EP 1 139 046 A1, EP 1 146 301 A1, EP 1 150 082 A1, EP 1 213 552 A1, DE 101 15 258 A1, EP 1 284 404 A1 (US 2003/051504 A1), EP 1 308 680 A1 (U.S. Pat. No. 6,612,129 B2), DE 102 13 212 A1, DE 102 13 211 A1, EP 1 357 342 A1, DE 102 38 282 A1, DE 103 02 389 A1, DE 103 34 559 A1, DE 103 34 560 A1, DE 103 32 863 A1, EP 1 544 559 A1, EP 1 585 926 A1, DE 102005 029 274 A1, EP 1 666 824 A1, EP 1 672 301 A1, DE 10 2005 028 012 A1, WO 2007/033838 A1, WO 2007/104449 A1, EP 1 845 324 A1, DE 10 2006 032 731 A1, EP 1 892 490 A1, DE 10 2007 014 643 A1, EP 2 015 012 A2, EP 2 015 013 A2, EP 2 026 024 A1, WO 2009/095188 A2 and DE 10 2008 016 355 A1.

The present explanations can also be used as appropriate for other air products such as nitrogen or argon, which can also be obtained in the gaseous state by using internal compression and are previously present as liquid fractions. However, the invention is also suited to all other fractions which are present in the liquid state in a corresponding air separating plant and in particular to those fractions which are pressurized in the liquid state or are to be pressurized in the liquid state. These can also be withdrawn from the plant in the liquid state.

In order to increase the pressure of air products in separating plants, it is known to use what is termed pressurization compression, which is for example described in DE 676 616 C and EP 0 464 630 A1. As disclosed for example in U.S. Pat. No. 6,295,840 B1, an air product can also be pressurized in a tank arrangement by means of a partial flow of compressed feed air.

Certain industrial uses require air products, e.g. compressed oxygen, of high purity and in particular of a specified degree of purity. These requirements can be satisfied, in particular in conventional air separating plants with internal compression, only with great difficulty or not at all.

There is therefore a need for improved possibilities for generating corresponding air products, in particular of a specified degree of purity, in air separating plants, in particular in air separating plants with internal compression.

DISCLOSURE OF THE INVENTION

Against this backdrop, the present invention proposes a method for obtaining an air product in an air separating plant and an air separating plant set up for carrying out such a method.

Advantages of the Invention

The invention proceeds from a known method for obtaining air products. For example, the invention can be used in the context of internal compression as explained in the introduction, although it is generally suited to all methods for obtaining air products in which these products are at least temporarily present in the liquid state and can be temporarily stored in corresponding tanks. As explained, internal compression obtains, from feed air, a liquid fraction which is pressurized in liquid form to a target pressure, then vaporized against a heat transfer medium, and is finally discharged in the gaseous state as an air product. This generally corresponds to the client's wishes. However, the method according to the invention is also of advantage to plants in which an air product can be discharged in the liquid state. In the latter case, the air product corresponds to the liquid fraction, in the context of internal compression the liquid fraction is vaporized to give the air product. It is provided to temporarily store the liquid fraction in a tank arrangement having at least two tanks, in particular prior to vaporization in the context of internal compression. In that context, the liquid fraction is alternately injected into and withdrawn from the at least two tanks.

"Alternating" between the at least two tanks is to be understood here as meaning that the liquid fraction is fed to at least one of the tanks and/or is withdrawn from at least one of the tanks and, in that context, is not simultaneously fed to and (at least not for providing the air product) withdrawn from one of the tanks. Injection into and withdrawal from any one tank thus never occurs simultaneously if the corresponding liquid fraction is subsequently (e.g. after vaporization) to be discharged as an air product. Therefore, in production operation, the tank is always either filled or emptied or neither filled nor emptied (i.e. the liquid fraction is always either injected into the tank or withdrawn from the latter). This results in a number of advantages which will be explained in more detail in the context of the explanation of the preferred embodiments.

In the simplified case of only two tanks, it is then possible for the liquid fraction to be fed to a first tank and withdrawn from a second tank, or vice versa. However, the liquid fraction can also be withdrawn from or fed to one of the tanks while it is not fed to or withdrawn from the other tank. The liquid fraction can also be simultaneously fed to both tanks, but not simultaneously withdrawn therefrom, or can be simultaneously withdrawn from both tanks, but not simultaneously fed thereto. This also holds, in each case in corresponding fashion, for more than two tanks.

It is provided according to the invention, and possible by means of alternating operation, in each case prior to withdrawal of the liquid fraction for providing the air product, to determine the composition of the liquid fraction, that is to say for example a content of at least one component, in the respective tank. Since due to the temporary storage a corresponding liquid fraction is never used directly for providing the air product, the latter can always be made available with a verified composition, for example with a defined purity. The generally desired gas product itself can generally not be monitored continuously with respect to its purity; this is however made possible by the temporary storage proposed here.

The method proposed according to the invention displays particular advantages if the pressure of the liquid fraction for providing the air product is raised in the liquid state to a target pressure, the liquid fraction is then vaporized against a heat transfer medium and is finally discharged in the gaseous state as the air product, that is to say in the context of what are termed internal compression methods. In this case, the compression takes place in particular in the main heat exchanger of the air separating plant. Internal compression is used as an alternative for gaseous product compression (external compression) if the gaseous product is to be obtained under pressure. In this context, the continuously produced liquid fraction is however conventionally discharged without the temporary storage, in the at least two tanks, according to the invention. Discharging possibly contaminated air products, which do not correspond to the respective requirements, can thus be prevented only with substantial additional expenditure. According to the invention, by contrast, it is always possible to discharge an air product having a defined and specifiable composition.

A "main heat exchanger" when mentioned in this application is to be understood in the following as preferably a single heat exchanger block. In the case of larger plants, it can however also be advantageous for the main heat exchanger to consist of multiple trains which are connected in parallel with respect to the temperature profile, and which are formed by mutually separate components. It is in principle possible to form the main heat exchanger, or each of its trains, from two or more series-connected heat exchanger blocks.

The term "vaporization" includes in this context, as explained in the introduction, pseudo-vaporization at supercritical pressure. The pressure at which the liquid fraction, for example pure oxygen, is introduced into the heat exchanger for vaporization (e.g. the main heat exchanger) can thus also lie above the critical pressure. This holds accordingly for the pressure of the heat transfer medium, for example the feed air, which is liquefied (or pseudo-liquefied) against the liquid fraction. It can in this context also be significant that the quantity is so small that no additional booster compressor is required.

Within the context of the present invention, the liquid fraction, for example pure oxygen (but also for example hydrogen, argon, helium and/or neon, also from external sources), can also, as in conventional air separating plants with internal compression, be raised to a higher pressure ("pressurized") in the liquid state. It is thus possible fobr a hot compressor for a corresponding air product to be dispensed with or at least to be made relatively small. Dispensing with an additional compressor unit generally improves the purity of the obtained gaseous air product, as contamination by diffusion through seals etc. is avoided.

Particularly pure air products can be obtained if the liquid fraction is pressurized by pressurization vaporization using the tank arrangement designed according to the invention. Pressurization vaporization is known in principle. This involves part of the contents of a corresponding tank being withdrawn and vaporized. The expansion during vaporization causes an increase in pressure. Here, in the context of the present invention, use is advantageously made of a process pressure of 8 to 16 bar. The use of additional pumps, which can also be a source of contamination, can be omitted or these can be made smaller. A corresponding plant thus proves to be much lower-maintenance than conventional plants with corresponding pumps. Plants according to the invention permit, when using pressurization vaporization, an energy saving of approximately 0.8 to 1 kW per standard cubic meter and hour of oxygen product at purities of for example less than 10 ppb Ar. The values which can be achieved in each case are dictated in large part by the production parameters.

Pressurization vaporization does not exclude the use of pumps, these can be provided upstream or downstream of a corresponding tank arrangement. If no pressurization vaporization is used, it is possible to raise the pressure of the liquid fraction by means of corresponding pumps prior to, during or after the temporary storage according to the invention. The invention is in particular suitable, also in the case of the unpressurized temporary storage in the tank arrangement, in particular if the liquid fraction is withdrawn unpressurized from the plant as air product or is pressurized only downstream of the tank arrangement. Usually, however, use is made of pressures for example up to 5 bar which make it possible to withdraw the air product even without a pump. It can also be advantageous in this context, prior to refilling a corresponding tank, to return, into a suitable column of the distillation column system used, the gas vented for pressure reduction (what is referred to as blow-off gas).

Within the scope of the method according to the invention, however, the liquid fraction is used for providing the air product only when its composition determined in the tank arrangement corresponds to a setpoint value, for example a minimum purity of at most 10 ppm of residual argon or preferably at most 500 ppm of nitrogen. If this is not the case, the liquid fraction can be discarded or can be fed back to the air separating plant at a suitable point, for example a pure oxygen column.

Advantageously, the composition of the liquid fraction is determined continuously or at intervals. This can take place at least prior to withdrawal for providing the air product, but can also be repeated, in particular if a tank is only partially filled in order to avoid excess production of the liquid fraction which is not in accordance with specifications. In that context, gas chromatography is particularly suited for determining a composition of the liquid fraction as it has particularly low detection limits.

The present invention is particularly suited to use with the applicant's "SPECTRA" method. In this context, a separation column can have a top condenser in which vapor from the upper region of the separation column can be at least partially condensed. This is a nitrogen product which can subsequently be withdrawn from the plant in liquid form. At least part of the condensate obtained in the top condenser can also be used as return flow to the separation column.

Furthermore, fluid is withdrawn from the separation column and is heated in the top condenser against the fluid to be condensed. The fluid can be withdrawn from the separation column in the form of one or two fluid flows or can be split into two fluid flows only after heating. Separate fluid flows withdrawn from the separation column are preferably withdrawn from the latter at different withdrawal heights and therefore have different compositions. In that context, one of the two fluid flows can preferably be drawn off at the sump of the separation column. In certain cases, it can prove to be expedient ifa first fluid flow has a higher nitrogen content than a second fluid flow. In this case, the second fluid flow is drawn off at an intermediate point of the first separation column, which point is arranged above the sump, in particular above the point at which the first fluid flow is withdrawn.

One of the two fluid flows is further heated, e.g. in the main heat exchanger of the air separating plant, and is expanded in an expansion machine. The other fluid flow can be (re-)compressed, in a compressor coupled to the expansion machine, to the pressure of the corresponding separation column, and then cooled in the main heat exchanger to a corresponding temperature. It is particularly expedient in this context, to use a cold compressor for the recompression. A "cold compressor" is to be understood here as a compressor which can be operated with an inlet temperature of below 200 K, in particular below 150 K, preferably between 90 and 120 K.

The SPECTRA method is energetically particularly expedient because the expansion in the above-mentioned expansion machine performs work. The mechanical energy generated in this manner can be used at least in part for the recompression, as explained above. The mechanical energy is transmitted directly mechanically from the expansion machine to the recompressor, for example via a common shaft of the expansion machine and of the recompressor. In particular when the recompressor takes the form of a cold compressor, preferably only part of the mechanical energy generated by the expansion machine is transmitted to the recompressor, the remainder is "annihilated" in a hot brake device, e.g. a brake fan, a generator or a dissipative brake.

The fundamental concept of the present invention is therefore not to discharge the liquid fraction continuously and without further possibility for control as an air product, but rather to temporarily store the liquid fraction in at least two tanks. This makes it possible to monitor the tank contents in each case with respect to their chemical composition, in particular with respect to residual impurities. This can be performed discontinuously, for example every 10 minutes. Only when the obtained product corresponds to the purity requirements predefined in each case is it vaporized, for example in the main heat exchanger, and discharged as gaseous air product.

The present invention is particularly suited to a method in which the feed air is cooled in a main heat exchanger and is injected into a first separation column. In this context, pure oxygen is obtained as the liquid fraction in a second separation column from an oxygen-enriched flow from the first separation column. After temporary storage and pressurization, the pure oxygen is vaporized in the main heat exchanger against at least part of the feed air as heat transfer medium.

In the same way, the invention relates to an air separating plant which is set up for carrying out a method as explained above and which has corresponding means. The air separating plant has the advantage of the above-explained advantages in the same manner. Reference is made thereto.

In this context, statements to the effect that in such an air separating plant flows, fractions, air products etc. can be "withdrawn", "injected", "heated", "cooled", "compressed", "expanded" etc. mean that there are provided corresponding withdrawal or introduction means (e.g. valves or pumps), means for heating or cooling (e.g. heaters or heat exchangers) and means for compressing or expanding (e.g. compressors or expansion valves or expansion machines) etc., which are of appropriate design.

In that context, an air separating plant of particularly advantageous design has a separation system from which the liquid fraction can be withdrawn at a withdrawal point that lies geodetically above an injection point into the tank arrangement. The liquid fraction can thus flow into the tank arrangement in a manner that saves energy. However, this is generally supported by an applied pressure. "Geodetically above" is to be understood in that context that there is a height difference between the withdrawal point from the separation column system and the injection point into the tank arrangement, but not that these need necessarily be arranged vertically one above the other. It is therefore possible for a lateral offset to be present. In larger plants, however, the tanks are generally at a height which ensures that the air product is provided at sufficient pressure.

The invention, as well as further details of the invention, will be explained in more detail below in comparison with the prior art and with reference to an exemplary embodiment represented schematically in the drawing.

BRIEF DESCRIPTION OF THE DRAWINGS

In the figures, identical or mutually corresponding elements are indicated with identical reference signs. Explanations will not be repeated, for the sake of clarity.

EMBODIMENT(S) OF THE INVENTION

Figure 1:
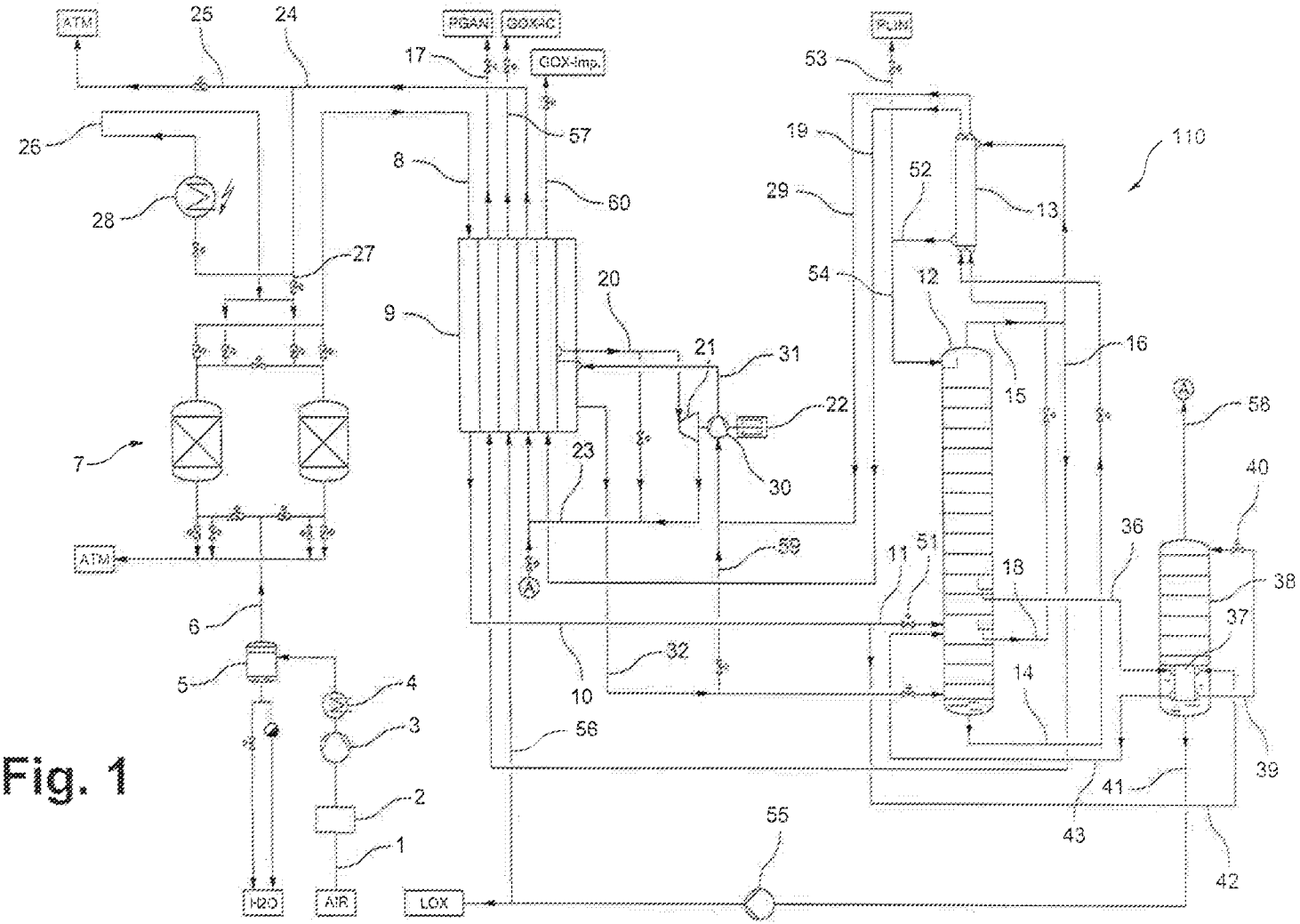
FIG. 1 shows an air separating plant according to the prior art.

FIG. 1 shows, schematically in the form of a plant diagram, an air separating plant with internal compression according to the prior art, as is known for example from EP 1 995 537 A2. The air separating plant set up for internal compression, as a whole, is given the label 110. As mentioned, however, the invention is also suited to use in air separating plants without internal compression.

Atmospheric air 1 (AIR) is drawn in, via a filter 2, by an air compressor 3 where it is compressed to an absolute pressure of between 6 and 20 bar, preferably approximately 9 bar. After flowing through an after cooler 4 and a water separator 5 for separating off water ($H_2O$), the compressed air 6 is purified in a purification apparatus 7 which has a pair of containers filled with adsorption material, preferably a molecular sieve. The purified air 8 is cooled to near dew point, and partially liquefied, in a main heat exchanger 9. A first part 11 of the cooled air 10 is introduced, via a throttle valve 51, into a single column 12. The injection preferably takes place several practical or theoretical trays above the sump.

The operating pressure of the single column 12 (at the top) is between 6 and 20 bar, preferably approximately 9 bar. Its top condenser 13 is cooled with a first fluid flow 14 and a second fluid flow 18. The first fluid flow 14 is drawn off from the sump of the single column 12, the second fluid flow 18 is drawn off from an intermediate point which is several practical or theoretical trays above the air injection, or which is at the same height as the latter.

Gaseous nitrogen 15, 16 is drawn off at the top of the single column 12 as the main product of the single column 12, is heated in the main heat exchanger 9 to approximately ambient temperature, and is finally drawn off via line 17 as a pressurized gas product (PGAN). Further gaseous nitrogen is fed through the top condenser 13. A part 53 of the condensate 52 obtained in the top condenser 13 can be obtained as liquid nitrogen product (PLIN); the remainder 54 is delivered to the top of the single column 12 as return flow.

The first fluid flow 14 is vaporized in the top condenser 13 at a pressure of between 2 and 9 bar, preferably approximately 4 bar, and flows in gaseous form via line 19 to the cold end of the main heat exchanger 9. It is withdrawn from the latter (line 20) at an intermediate temperature and, in an expansion machine 21 which in the example takes the form of a turbo expander, is expanded, so as to perform work, to approximately 300 mbar above atmospheric pressure. The expansion machine 21 is mechanically coupled to a cold compressor 30 and to a brake device 22 which in the exemplary embodiment takes the form of an oil brake. The expanded fluid flow 23 is heated in the main heat exchanger 9 to approximately ambient temperature. The hot fluid flow 24 is vented (line 25) to the atmosphere (ATM) and/or is used as regeneration gas 26, 27 in the purification apparatus 7, possibly after heating in the heating device 28.

The second fluid flow 18 is vaporized in the top condenser 13 at a pressure of between 2 and 9 bar, preferably approximately 4 bar, and flows in gaseous form via a line 29 to the cold compressor 30 where it is recompressed to approximately the operating pressure of the single column. The recompressed fluid flow 31 is cooled in the main heat exchanger 9 back down to the column temperature and is finally fed, via line 32, back to the sump of the single column 12.

An oxygen-enriched flow 36, which is essentially free from heavy volatile contaminants, is drawn off in the liquid state from an intermediate point in the single column 12, which point is arranged 5 to 25 theoretical or practical trays above the air injection point. Where appropriate, the oxygen-enriched flow 36 is supercooled in a sump vaporizer 37 of a pure oxygen column 38 and is then delivered, via a line 39 and a throttle valve 40, to the top of the pure oxygen column 38. The operating pressure of the pure oxygen column 38 (at the top) is between 1.3 and 4 bar, preferably approximately 2.5 bar.

The sump vaporizer 37 of the pure oxygen column 38 is also cooled by means of a second part 42 of the cooled feed air 10. The feed air flow 42 is then at least partially, for example entirely, condensed and flows via a line 43 to the single column 12 where it is introduced approximately at the height of the injection of the remaining feed air 11.

A high-purity oxygen product is withdrawn as the liquid fraction 41 from the sump of the pure oxygen column 38, is raised by means of a pump 55 to an increased pressure of between 2 and 100 bar, preferably approximately 12 bar, is fed via a line 56 to the cold end of the main heat exchanger 9 where it is vaporized at the increased pressure and is heated to approximately ambient temperature, and is finally obtained via line 57 as a gaseous product (GOX-IC).

A top gas 58 of the pure oxygen column 38 is mixed into the previously mentioned expanded second fluid flow 23 (cf. connection A). Where relevant, part of the feed air is guided via a bypass line 59 to the inlet of the cold compressor 30 for surge prevention of the latter (what is referred to as anti-surge control).

When necessary, it is possible to withdraw from the plant, upstream and/or downstream of the pump 55, liquid oxygen as liquid fraction (labelled LOX in the drawing). In addition, an external liquid, for example liquid argon, liquid nitrogen or liquid oxygen, can be vaporized in the main heat exchanger 9 in indirect exchange of heat with the feed air (not shown in the drawing).

Figure 2:
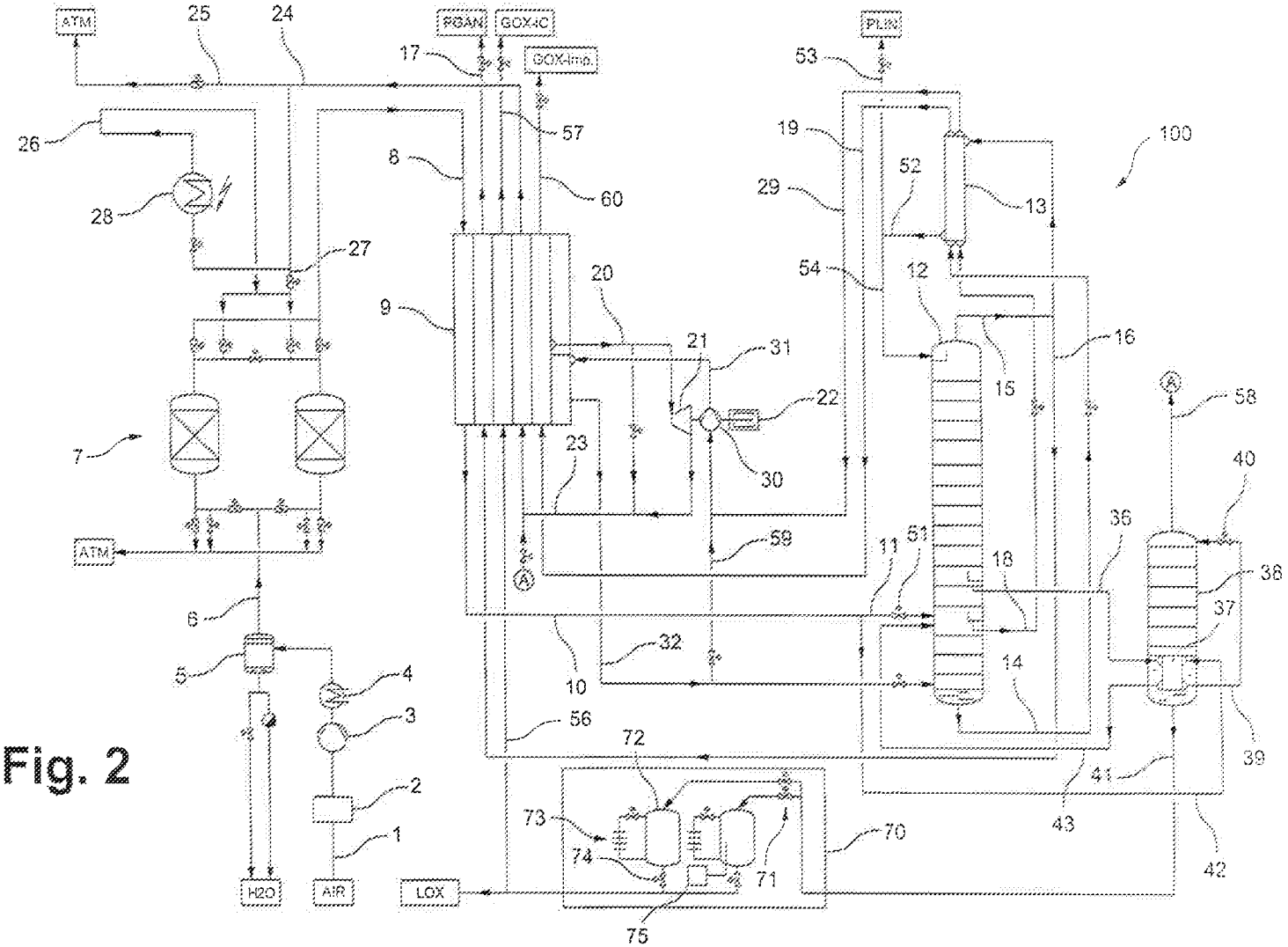
FIG. 2 shows an air separating plant according to one embodiment of the invention.

FIG. 2 shows, schematically, an air separating plant according to a particularly preferred embodiment of the invention, which as a whole is provided with the label 100. The air separating plant 100 shown in FIG. 2 differs from the air separating plant 110 shown in FIG. 1 essentially by a tank arrangement 70 having multiple tanks 72, two in the example shown.

The tank arrangement 70 comprises, in the example shown, two tanks 72 of identical construction, of which only the left-hand tank 72 will be explained here in further detail. As mentioned above, the air separating plant 100 according to the invention can also be designed with more than two tanks 72. The tanks 72 can be arranged upright or recumbent and for example can be filled from above or from below. The tank arrangement 70 further comprises in the example shown a valve pair 71 by means of which the tanks 72 can be filled in alternation or in parallel. It is to be understood that, if a greater number of tanks 72 is provided, there is accordingly provided a greater number of valves.

The tank arrangement 70 can for example be arranged geodetically below a withdrawal point from the pure oxygen column 38, in this case therefore below the lowest point of the pure oxygen column 38, in order to support the transfer of the liquid fraction 41 into the tank arrangement 70. In general, however, the pure oxygen column 38 is operated at a pressure, for example 3 bar, which ensures the transfer of the liquid fraction 41 into the tank arrangement 70.

In the example shown, each of the tanks 72 is assigned pressurization vaporizer 73. The pressurization vaporizers 73 operate in a manner which is known in principle. In each case, a small quantity of the oxygen product 41 present in the corresponding tank 72 is withdrawn from the bottom region of the tanks 72, is heated and is injected into the top of the tank via a valve which is not shown in more detail. The vaporization increases the pressure in the tanks 72. By virtue of the pressurization vaporization, the tank arrangement 70 can entirely replace the above-mentioned pump 55, as an alternative however can also be provided in addition to a corresponding pump 55 (not shown in FIG. 2).

As already explained, the tanks 72 in the air separating plant 100 according to the invention are operated in alternation, wherein, as explained, the liquid fraction 41 is fed to at least one of the tanks 72 and/or is withdrawn from at least one of the tanks 72 but in that context is not simultaneously fed to one of the tanks 72 and withdrawn therefrom for providing the air product.

For example, in this context only one of the valves of the valve pair 71 is open at any one time. Thus, the tank 72 associated with the corresponding valve is filled. A corresponding bottom-side valve 74 is closed. Simultaneously, or only after sufficient filling of the corresponding tank 72, the pressure in the respective tank 72 is raised by means of the pressurization vaporizer 73. Once the corresponding tank 72 is sufficiently full and is at the desired pressure, the corresponding valve of the valve pair 71 is closed (and the respective other is opened) and then a valve 74 on the bottom side of the tank 72 is opened (and the respective other is closed). The pure oxygen contained in the tank 72 can therefore, as explained above, flow via the line 56 to the cold end of the main heat exchanger 9, wherein it is vaporized at the increased pressure and heated to approximately ambient temperature, and finally withdrawn via line 57. At the same time, the other tank 72 is filled.

The air separating plant 100 according to the invention, with the tank arrangement 70, proves to be particularly advantageous in that context because the liquid oxygen which is in each case present in the corresponding tanks 72 is not directly delivered at the plant boundary, i.e. in particular not without further monitoring. It is further provided to continuously or intermittently monitor the purity of the oxygen in the respective tank 72 by means of a control device 75 which, in the example represented, is visible only on the right-hand tank 72. The valve 74 arranged on the bottom side of the corresponding tank 72 is then opened only when the oxygen in the corresponding tank 72 is of sufficient purity. If this is not the case, the contents of the tank 72 can be discarded or recirculated, via a line which is not shown, for example into the pure oxygen column 38. This ensures that oxygen of high and in particular specifiable purity is always delivered at the plant boundary. This is not possible in conventional plants because, as explained, with a corresponding pump 55 oxygen is delivered continuously.

Continuous provision of pressurized oxygen at the plant boundary via the line 57 is still ensured because, as explained, the tanks 72 can be operated in alternation. It is thus always possible for oxygen to be withdrawn from one of the two tanks 72 via the valve 74 arranged on the bottom side while the respective other tank 42 is filled and monitored by means of the control device 75.

Any control device 75 known from the prior art can be used for monitoring purity. Purity monitoring is preferably carried out by means of gas chromatography.

A further advantageous aspect of the air separating plant 100 according to the invention results from the fact that, as explained, the ingress of contamination into the tank arrangement 70 is markedly reduced in comparison to compression by means of a pump 55. Known sources of contamination in the context of pumps include the pump seals, which are entirely unnecessary in the tank arrangement 70.

The invention claimed is:

1. A method for obtaining an air product in an air separating plant, said method comprising:

obtaining a liquid fraction from feed air and said liquid fraction is used at least in part for providing said air product, introducing said liquid fraction is into a tank arrangement having at least two tanks, wherein said liquid fraction is fed to one or more of said tanks of the tank arrangement and is withdrawn from one or more of said tanks of the tank arrangement to provide said air product and said liquid fraction is not simultaneously fed to and withdrawn from any of said tanks, and wherein, prior to withdrawing liquid fraction from said one of the tanks, the composition of the liquid fraction within said one of the tanks is determined.

2. The method as claimed in claim 1, further comprising pressurizing in the liquid state the liquid fraction used to provide said air product to a target pressure, and wherein the liquid fraction is subsequently vaporized against a heat transfer medium and then discharged from said plant in the gaseous state as said air product.

3. The method as claimed in claim 2, wherein said pressurizing of the liquid fraction is performed in the tank arrangement by pressurization vaporization.

4. The method as claimed in claim 3, wherein said liquid fraction is only withdrawn from a tank of the tank arrangement to provide air product only when said composition of the liquid fraction within said tank of the tank arrangement is determined to correspond to a setpoint value.

5. The method as claimed in claim 1, wherein said feed air is cooled in a main heat exchanger and then is injected into a first separation column of the air separating plant, wherein an oxygen-enriched flow from the first separation column is introduced into a second separation column of said plant and a pure oxygen is obtained from said second distillation column as said liquid fraction and the pure oxygen is stored in the tank arrangement, then pressurized and subsequently vaporized in the main heat exchanger against at least part of the feed air as heat transfer medium, and then discharged from the plant in gaseous form as the air product.

6. The method as claimed in claim 5, wherein a first fluid flow and a second fluid flow are is withdrawn from the first separation column and heated in a top condenser of the first separating column, and wherein said first fluid flow is further heated in the main heat exchanger and then expanded in an expansion machine, and said second fluid flow is compressed in a compressor coupled to said expansion machine, then cooled in the main heat exchanger and then injected into the first separation column.

7. An air separating plant comprising:

a separation system for obtaining a liquid fraction from feed air, and said separation system having a discharge system wherein at least part of the liquid fraction is used to provide an air product, said discharge system comprising a tank arrangement with at least two tanks set up to store the liquid fraction, and means for feeding the liquid fraction to at least one of the tanks and means for withdrawing the liquid fraction from one or more of the tanks to provide the air product and said means for feeding and said means for withdrawing cannot simultaneously feed and withdraw the liquid fraction from any of the tanks of the tank arrangement, and, and a control device for determining the composition of the liquid fraction prior to the liquid fraction being withdrawn from a tank of the tank arrangement to provide the air product.

8. The air separating plant as claimed in claim 7, further comprising means for pressurizing the liquid fraction in the liquid state to a target pressure, means for vaporizing the liquid fraction against a heat transfer medium, and means for discharging the vaporized liquid fraction from the plant as the gaseous air product.

9. The air separating plant as claimed in claim 7, further comprising at least one main heat exchanger for cooling the feed air, a first separation column into which cooled feed air from the at least one main heat exchanger is injected, and a second separation column for obtaining, from an oxygen-enriched flow from the first separation column, pure oxygen as the liquid fraction, and means in said at least one main heat exchanger for vaporizing the pure oxygen, after storage of the pure oxygen in the tank arrangement and after pressurization of the pure oxygen, against at least part of the feed air as heat transfer medium.

10. The air separating plant as claimed in claim 9, further comprising means for withdrawing a first fluid flow and means for withdrawing a second fluid flow from the first separation column and introducing said first fluid flow and said second fluid flow into a top condenser of the first separation column to heat said first fluid flow and said second fluid flow, and means for further heating the first fluid flow in said main heat exchanger, an expansion machine for expanding the further heated first fluid flow, a compressor for compressing the second fluid flow, wherein said compressor is coupled to the expansion machine, means for cooling the expanded second fluid flow in said main heat exchanger, and means for introducing the cooled, expanded second fluid flow into the first separation column.

11. The air separating plant as claimed in claim 7, further comprising means for withdrawing the liquid fraction from the separation system at a withdrawal point which lies geodetically above an injection point for introducing the liquid fraction into the tank arrangement.

12. The method as claimed in claim 5, wherein a fluid flow is withdrawn from the first separation column and heated in a top condenser of the first separating column, and after being heated in said top condenser said fluid flow is divided into a first fluid flow and a second fluid flow, and wherein said first fluid flow is further heated in the main heat exchanger and then expanded in an expansion machine, and said second fluid flow is compressed in a compressor coupled to said expansion machine, then cooled in the main heat exchanger and then introduced into the first separation column.

* * * * *